US012583561B2

(12) United States Patent
Belvisi

(10) Patent No.: US 12,583,561 B2
(45) Date of Patent: Mar. 24, 2026

(54) SAILING BOAT WITH AN AUXILIARY HYDRODYNAMIC SURFACE

(71) Applicants: Marco Calatroni, Rho (IT); Francesco Belvisi, Pantelleria (IT)

(72) Inventor: Francesco Belvisi, Pantelleria (IT)

(73) Assignees: Francesco Belvisi, Trapani (IT); Marco Calatroni, Milan (IT)

( * ) Notice: Subject to any disclaimer, the term of this patent is extended or adjusted under 35 U.S.C. 154(b) by 702 days.

(21) Appl. No.: 17/930,563

(22) Filed: Sep. 8, 2022

(65) Prior Publication Data

US 2023/0073329 A1 Mar. 9, 2023

(30) Foreign Application Priority Data

Sep. 9, 2021 (IT) ..... 102021000023279

(51) Int. Cl.
*B63B 39/06* (2006.01)
*B63B 1/24* (2020.01)

(52) U.S. Cl.
CPC ..... *B63B 39/062* (2013.01); *B63B 1/24* (2013.01)

(58) Field of Classification Search
CPC ..... B63B 39/00; B63B 39/06; B63B 39/062; B63B 2039/065; B63B 1/00; B63B 1/16; B63B 1/24; B63B 1/242; B63B 1/28; B63B 2001/281; B63B 1/285; B63B 1/30
USPC ..... 114/89, 90, 91, 97, 98, 39.11, 39.21, 114/39.24, 121, 122, 124, 126, 271, 273, 114/274, 278, 280, 282
See application file for complete search history.

(56) References Cited

U.S. PATENT DOCUMENTS

| | | | | |
|---|---|---|---|---|
| 3,295,487 A | | 1/1967 | Smith | |
| 4,592,298 A | * | 6/1986 | Finot | B63H 9/061 114/274 |
| 4,674,427 A | * | 6/1987 | Finot | B63B 1/322 114/247 |
| 4,943,250 A | * | 7/1990 | DuPont | B63H 16/10 440/102 |
| 6,016,759 A | * | 1/2000 | Russell | B63H 9/061 114/39.21 |

(Continued)

FOREIGN PATENT DOCUMENTS

| | | |
|---|---|---|
| EP | 0084995 B1 | 8/1986 |
| GB | 1581625 A | 12/1980 |
| GB | 1581626 A | 12/1980 |

OTHER PUBLICATIONS

Italian Search Report dated Apr. 29, 2022, 2 pp.

*Primary Examiner* — Daniel V Venne
(74) *Attorney, Agent, or Firm* — Heslin Rothenberg Farley and Mesiti P.C.; Victor A. Cardona, Esq.

(57) ABSTRACT

A sailing boat has an auxiliary hydrodynamic surface carried by a main boom connected in an oscillating way to a deck of the boat, about an axis of articulation parallel to the longitudinal direction of the boat. A drive system lowers the main boom on one side or the other of the boat in such a way that the hydrodynamic surface is selectively lowerable in a first operative position on one side of the boat to be put into the water on one side of the boat or in a second operative position on the other side of the boat to be put into the water on the other side of the boat. The boom is sized so that, when the hydrodynamic surface is located in one of its two operative positions on one side or the other of the boat, it is set at a lateral distance from the boat.

18 Claims, 8 Drawing Sheets

(56) References Cited

U.S. PATENT DOCUMENTS 6,341,571 B1 * 1/2002 Russell ..... B63H 9/061
114/39.21

* cited by examiner 6
1
7
4
9
10
11
11A
8A
8A
8
3
2

SAILING BOAT WITH AN AUXILIARY HYDRODYNAMIC SURFACE

CROSS REFERENCE TO RELATED APPLICATIONS

This application claims priority from Italian Patent Application No. 102021000023279 filed on Sep. 9, 2021, the entire disclosure of which is incorporated herein by reference.

FIELD OF THE INVENTION

The present invention relates to sailing boats of the type provided with one or more auxiliary hydrodynamic surfaces (foils) connected to the structure of the boat and each movable between a raised, inoperative, position and a lowered, operative, position, in which the hydrodynamic surface is put into the water on one side of the hull of the boat.

In the present description and in the ensuing claims, the expression "hydrodynamic surface" is used to indicate the element, constituted by one or more hydrofoils, that is prearranged for being put, as a whole, into the water.

PRIOR ART

Sailing boats of the type referred to above are, for example, described in the documents U.S. Pat. No. 7,644,672, WO 2013/142092 A1, U.S. Pat. Nos. 7,784,417, 8,967,063, 3,373,710, EP 3 216 689 B1, U.S. Pat. Nos. 6,499,419, 3,789,789 A, 3,802,366 A, 3,179,078 A, 10,377,447 B2, 10,829,181 B2, 3,747,549 A, and 2,856,879 A.

In the field of sailing boats there has for some time been felt the need to increase the performance by resorting to mobile systems that have the purpose of increasing the righting moment of the boat, for example by displacing the ballast, or the crew, or fluid masses on the upwind side of the boat in such a way as to counter as far as possible the listing thrust due to the action of the wind on the sails. Frequently, in regatta sailing boats the centreboard also performs the further function of lowering the centre of gravity, thanks to the masses connected to the centreboard, in such a way as to counter the leeway, owing to a hydrofoil associated to the centreboard. In the case where the centreboard is of the rocking type, the displacement of the masses guarantees a greater righting torque, which yields benefits in terms of performance. In the same way, a rocking centreboard offers a minimum resistance to the leeway, and hence in these configurations it proves advantageous to add mobile appendages, with a hydrofoil commonly referred to as "foil" or "canard", which are able to afford adequate resistance to the leeway. Advantageously, such appendages are at times set on the leeward side and with an inclination such as to lie vertically with respect to the surface of the water, irrespective of the listing of the boat. There are at times included horizontal surfaces aimed at generating a lift in the vertical direction that pushes the boat upwards, thus reducing the draught or at times keeping the boat entirely out of the water. In this case, it is advantageous for the vertical force to be generated leeward as far as possible from the centre of gravity of the boat in such a way as to offer a higher righting moment, to the benefit of performance. For this reason, regulating systems are frequently used with double or specular foils that enable regulation and balancing of the leeway and of the lift. Frequently, the maximum width of such configurations is limited for structural reasons or by class regulations, for practical reasons, and for reasons of cost.

The solutions for regulating the foil comprise rotation or translation of the entire foil or of some mobile parts (flaps), similar to what occurs in aeroplane wings.

The document EP 0 084 995 B1 presents a solution of the type comprising two different hydrodynamic surfaces that can be lowered into the water on one side and the other of the boat. The two hydrodynamic surfaces are carried at the ends of a hydrofoil structure that surmounts the boat and that can be rotated about a longitudinal axis of the boat in order to immerse in the water one of the two hydrodynamic surfaces carried at the ends of the hydrofoil structure.

Further solutions of sailing boats with auxiliary hydrodynamic surfaces are illustrated in U.S. Pat. No. 3,295,487 A, GB 1 581 625 A, and GB 1 581 626 A.

OBJECT OF THE INVENTION

The object of the present invention is to enhance the performance of a sailing boat with a device that will be able to generate a vertical righting force on one side of the boat, as far as possible from the centre of gravity of the boat.

A further object of the invention is to achieve the aforesaid purpose in a simple and functional way.

SUMMARY OF THE INVENTION

With a view to achieving the above objects, the subject of the invention is a sailing boat according to claim 1.

In a preferred embodiment, the aforesaid auxiliary hydrodynamic surface is carried by an auxiliary boom connected in an articulated way to one end of the aforesaid main boom, about an axis substantially parallel to the axis of articulation of the main boom to the deck of the boat.

In one embodiment, said auxiliary hydrodynamic surface comprises two hydrofoils, projecting in opposite transverse directions from said auxiliary boom. In a variant embodiment, the auxiliary hydrodynamic surface comprises two pairs of hydrofoils, set on top of one another and at a distance apart, which project in opposite transverse directions from said auxiliary boom. In a further example, each of said hydrofoils is provided with an orientable flap (as in an aeroplane wing).

In another embodiment, said auxiliary hydrodynamic surface is in the form of a rotor, with one or more blades and with an axis of rotation that, in the operative condition in the water, is substantially vertical, said rotor being configured to operate in autorotation and/or with rotation controlled by a motor.

The drive system that controls the position of the main boom may be motorized or manual. The same applies to the drive system that controls the position of the auxiliary boom with respect to the main boom. It is also possible to envisage that associated to the auxiliary boom is a position-control system configured in such a way as to force the auxiliary boom to assume a position depending uniquely upon the position of the main boom.

In one example, the drive system that controls the position of the main boom comprises a halyard cable for lifting the free end of the main boom into a central position above the boat, and two downhaul cables for pulling the main boom downwards, one cable towards one side and the other towards the other side of the boat.

It is also possible to envisage a simplified solution in which the main boom carries rigidly at its free end an H-shaped structure with two hydrodynamic surfaces projecting on opposite sides of the main boom, just one of which is immersed in the water when the main boom is lowered on one side or the other of the boat.

To prevent any interference between the main boom and the auxiliary boom when the main boom is carried from one side to the other of the boat, it is possible to envisage that the two booms will rotate in two parallel planes set apart from one another, or else, for example, that the main boom will have a forked structure, including two parallel boom elements set apart from one another, which define between them a space through which the auxiliary boom can pass when the main boom is displaced from one side to the other of the boat. Of course, also the configuration of the hydrodynamic surface must be such as to prevent any interference with the main boom when the latter is brought from one side to the other of the boat.

DETAILED DESCRIPTION OF AN EXAMPLE OF EMBODIMENT OF THE INVENTION

Further characteristics and advantages of the invention will emerge from the ensuing description with reference to the annexed drawings, which are provided purely by way of non-limiting example and in which.

Figure 3:
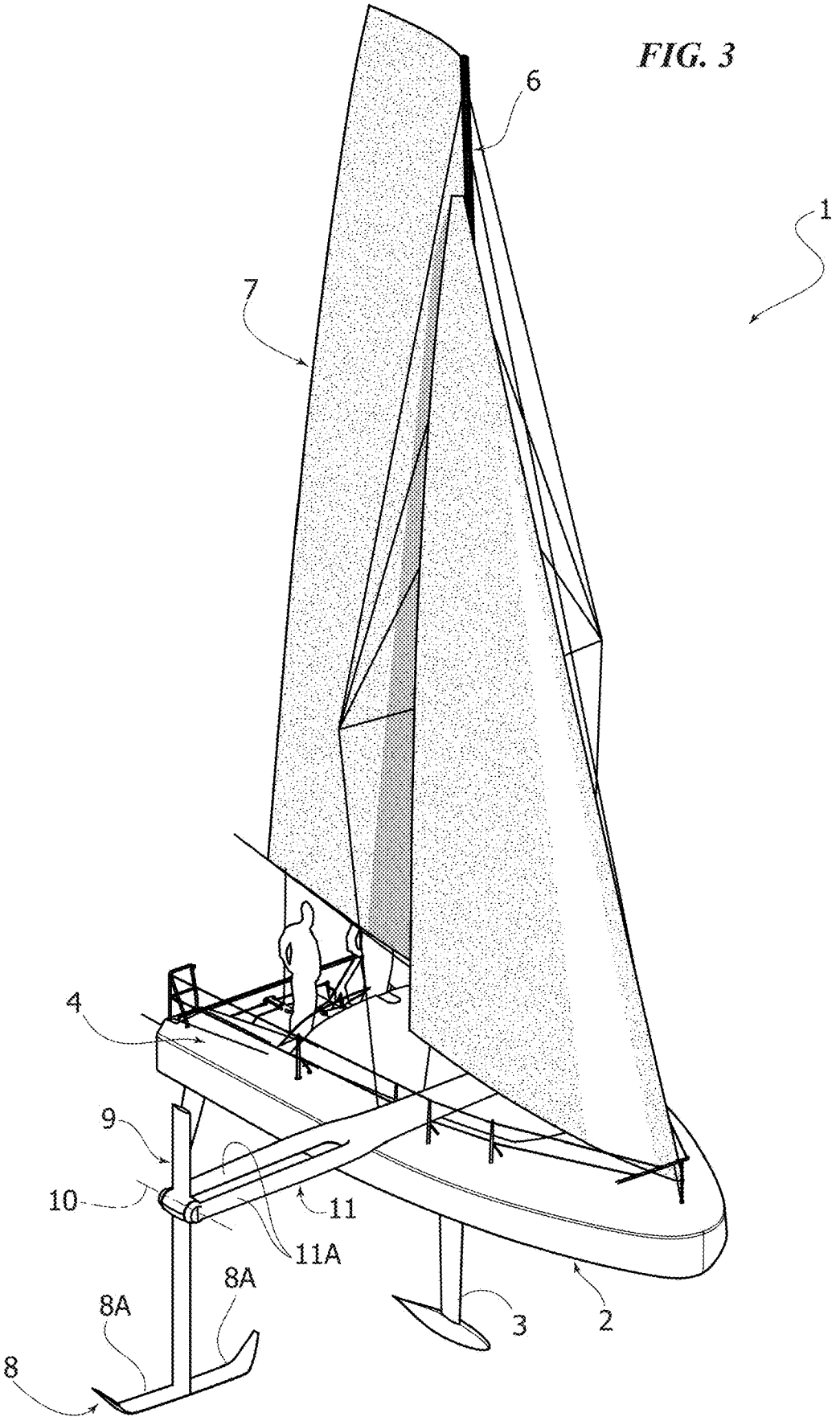
Figure 4:
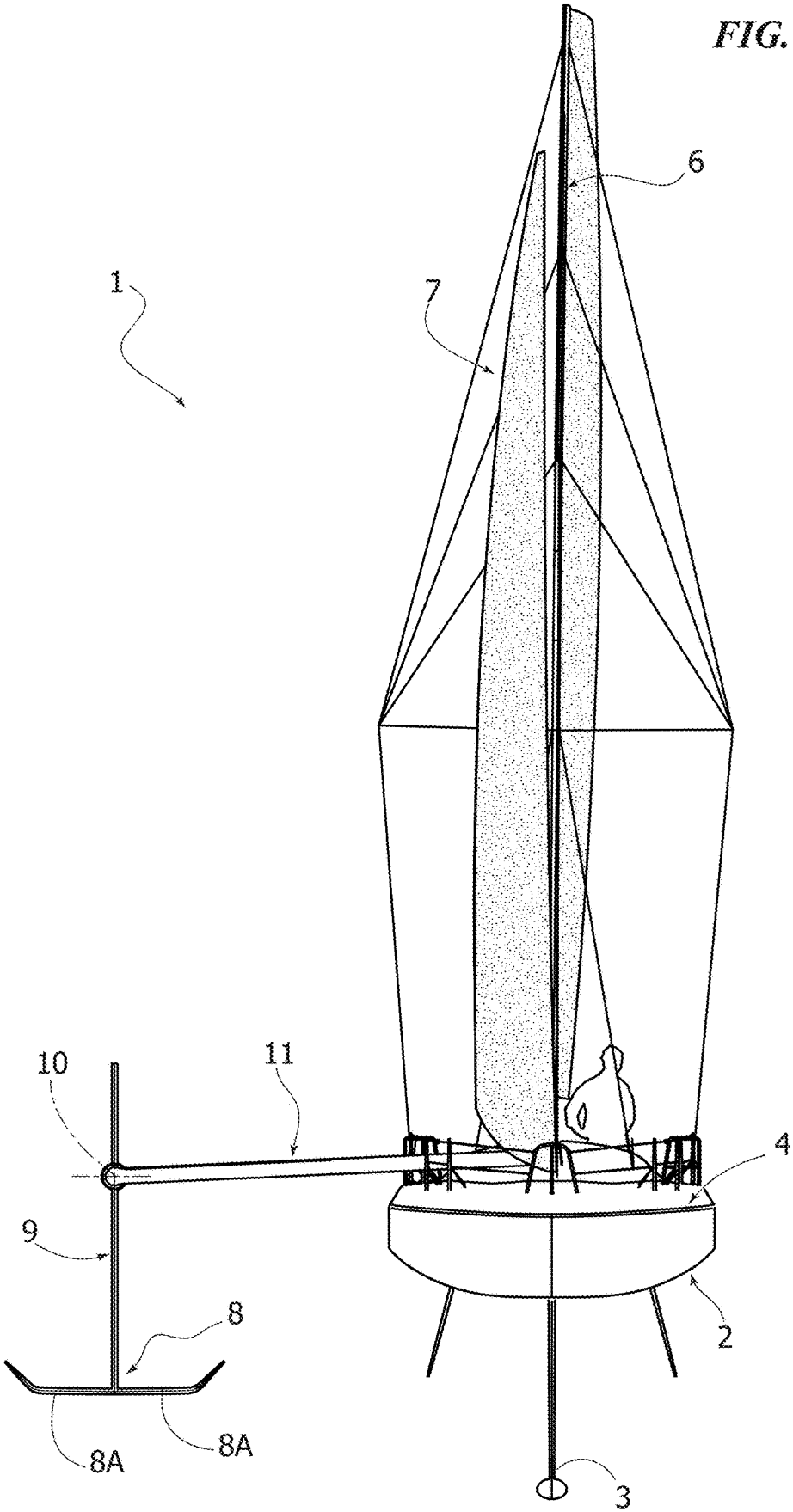
Figure 5:
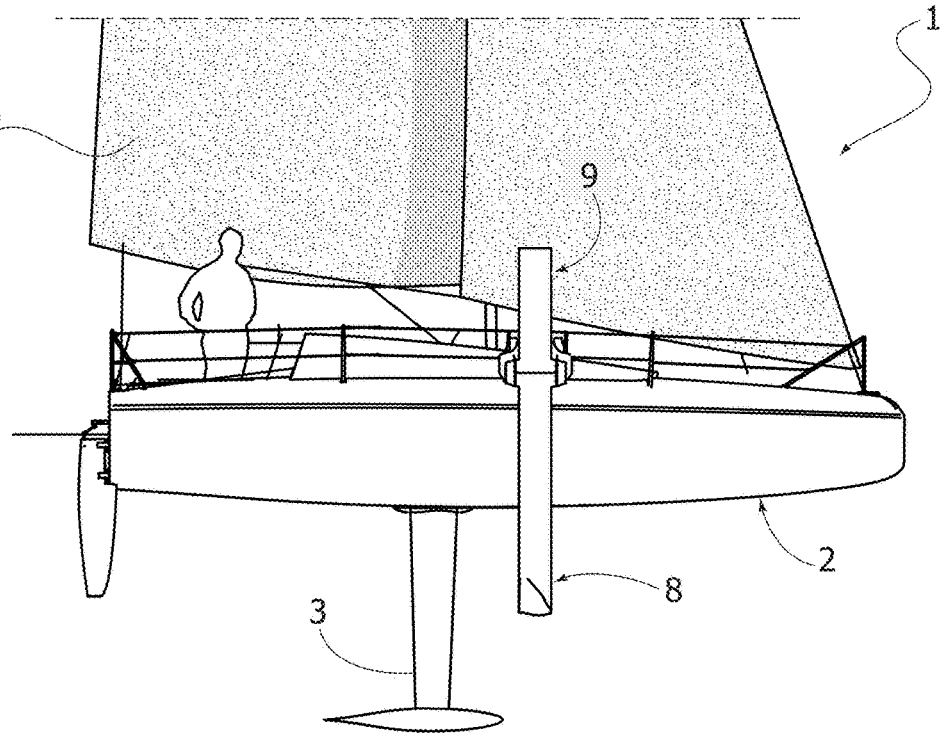
Figure 6:
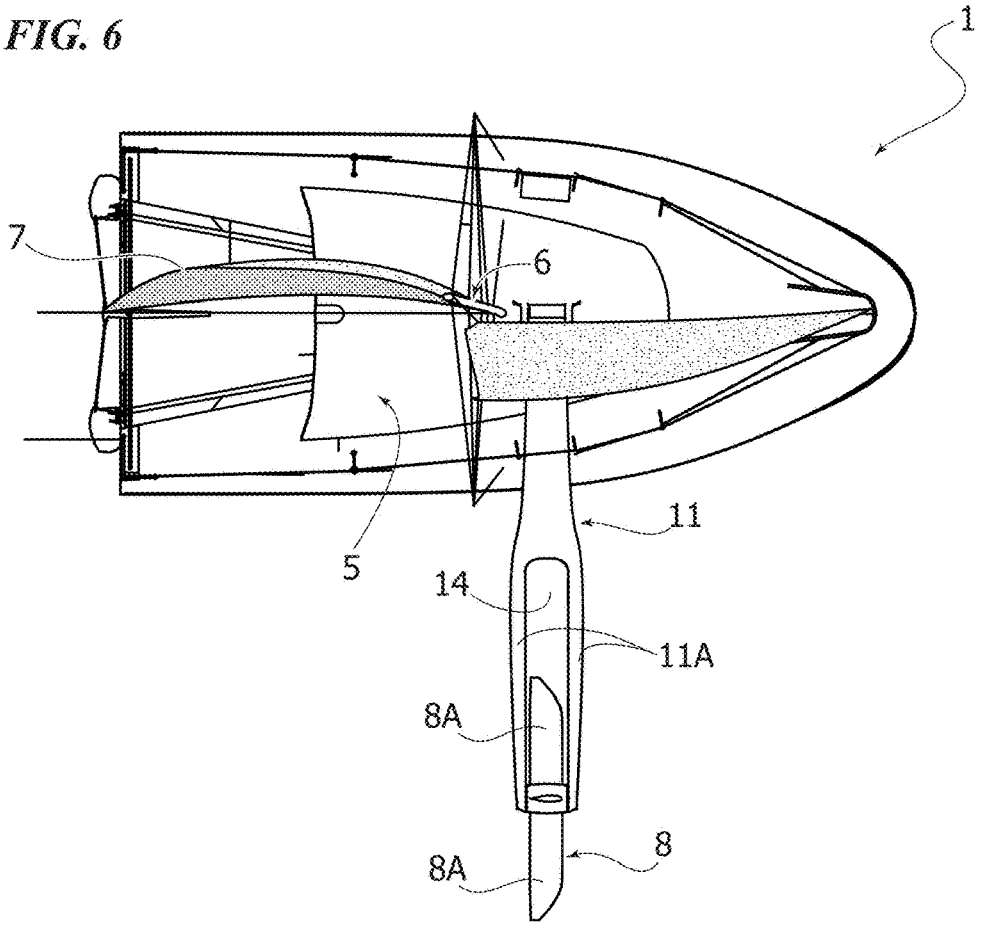
Figure 7:
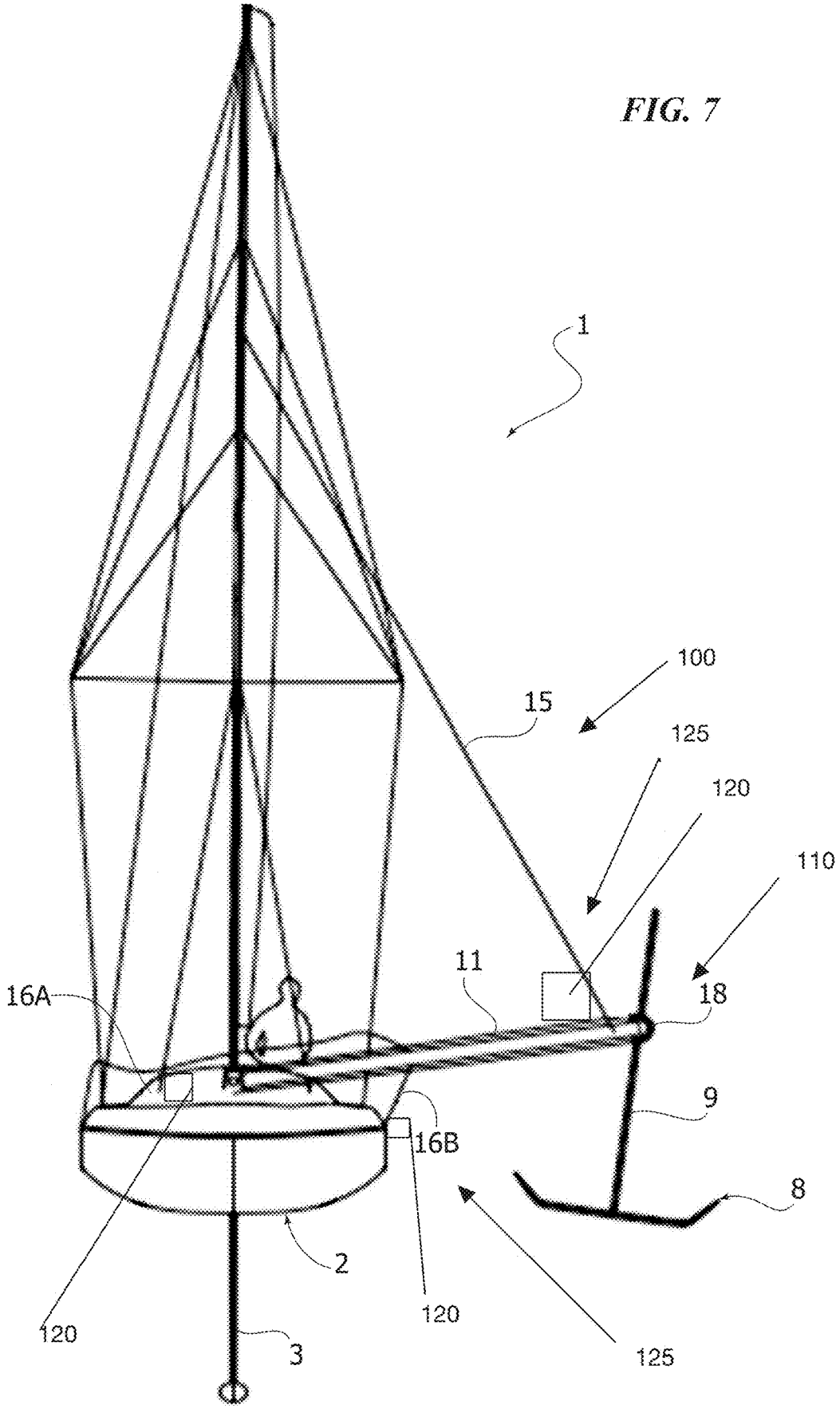
Figure 8:
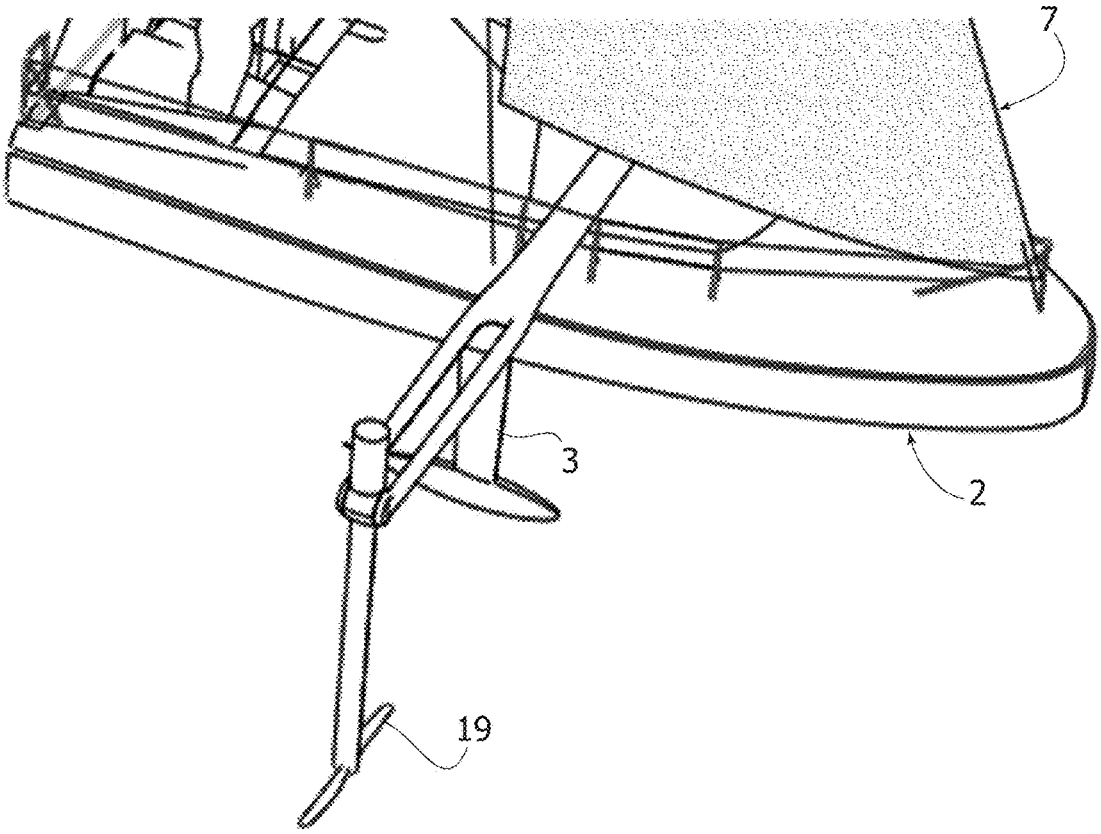
Figure 9:
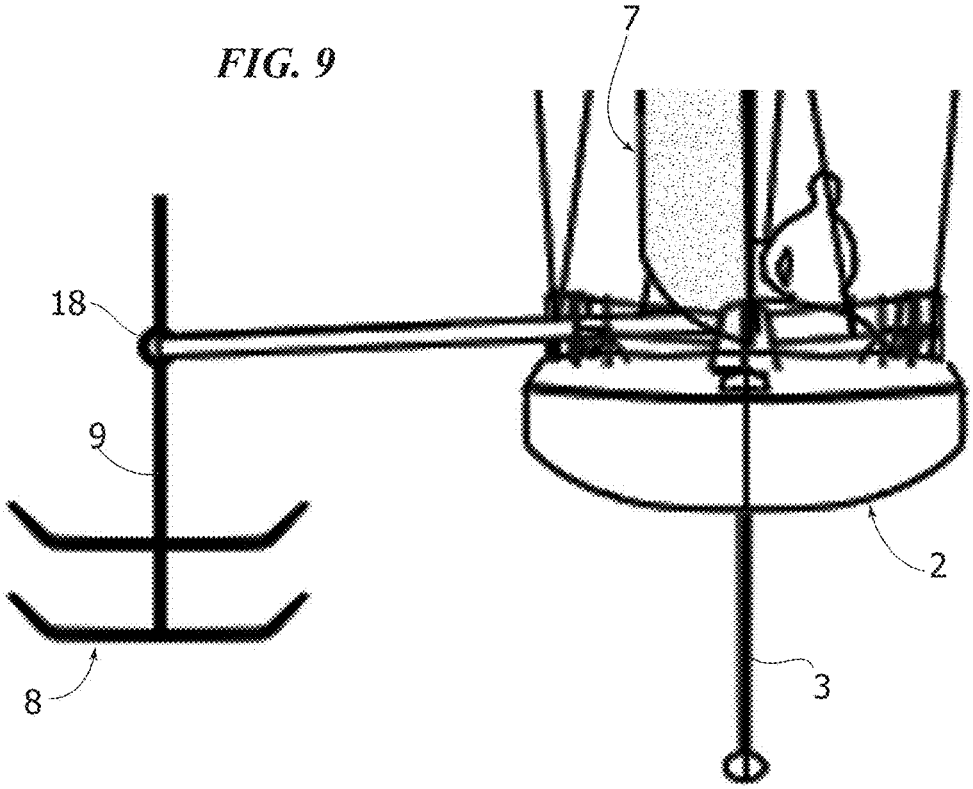
Figure 10:
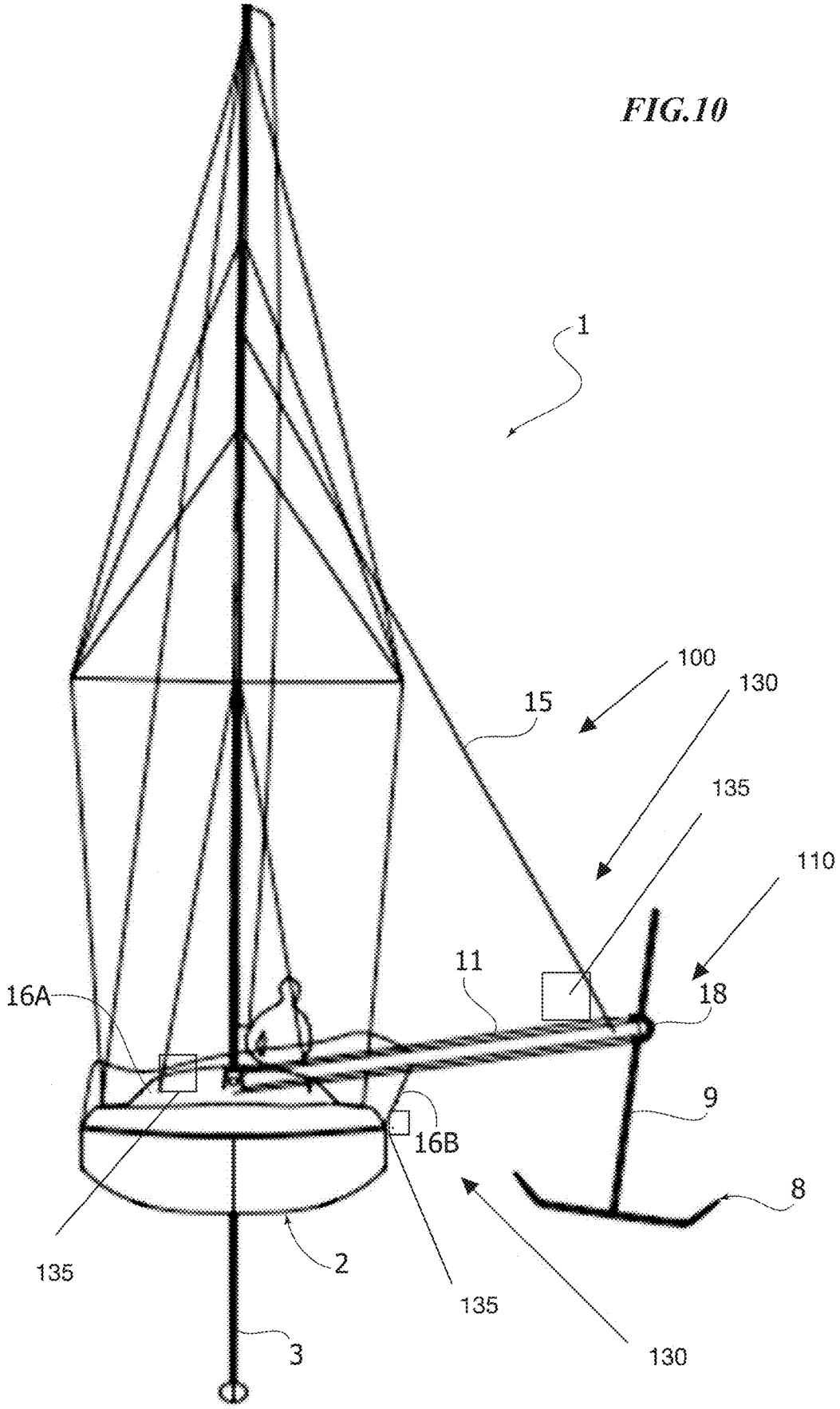

FIGS. 4, 5, and 6 are, respectively, an end view, a side view, and a top plan view of the boat according to the invention in the operative condition of FIG. 3;

FIG. 7 shows an example of a drive system for control of the position of the main boom of the device according to the invention;

FIGS. 8 and 9 show variants of the hydrodynamic surface provided in the device according to the invention; and FIG. 10 shows another example of a drive system for control of the position of the main boom of the device according to the invention.

In the drawings, the reference number 1 designates as a whole a sailing boat, comprising a hull 2 with a centreboard 3, projecting underneath from the hull 2, and a superstructure designated as a whole by 4, including a deck 5 from which there rises a mast 6 for a sail 7. It is evident that the present invention is of general application and that consequently the specific configuration of boat that is illustrated in the drawings is provided herein purely by way of non-limiting example.

According to the invention, associated to the boat 1 is an auxiliary hydrodynamic surface (foil) 8, which can be immersed in the water on one side or the other of the boat 1.

In the preferred example illustrated, the auxiliary hydrodynamic surface 8 is carried by an auxiliary boom 9 articulated about an axis 10 parallel to the longitudinal direction of the boat on the free end of a main boom 11, which is supported in an articulated way on the deck 5 about an axis of articulation 12 parallel to the longitudinal direction of the boat and parallel to the axis 10 of articulation of the auxiliary boom 9.

Figure 1:
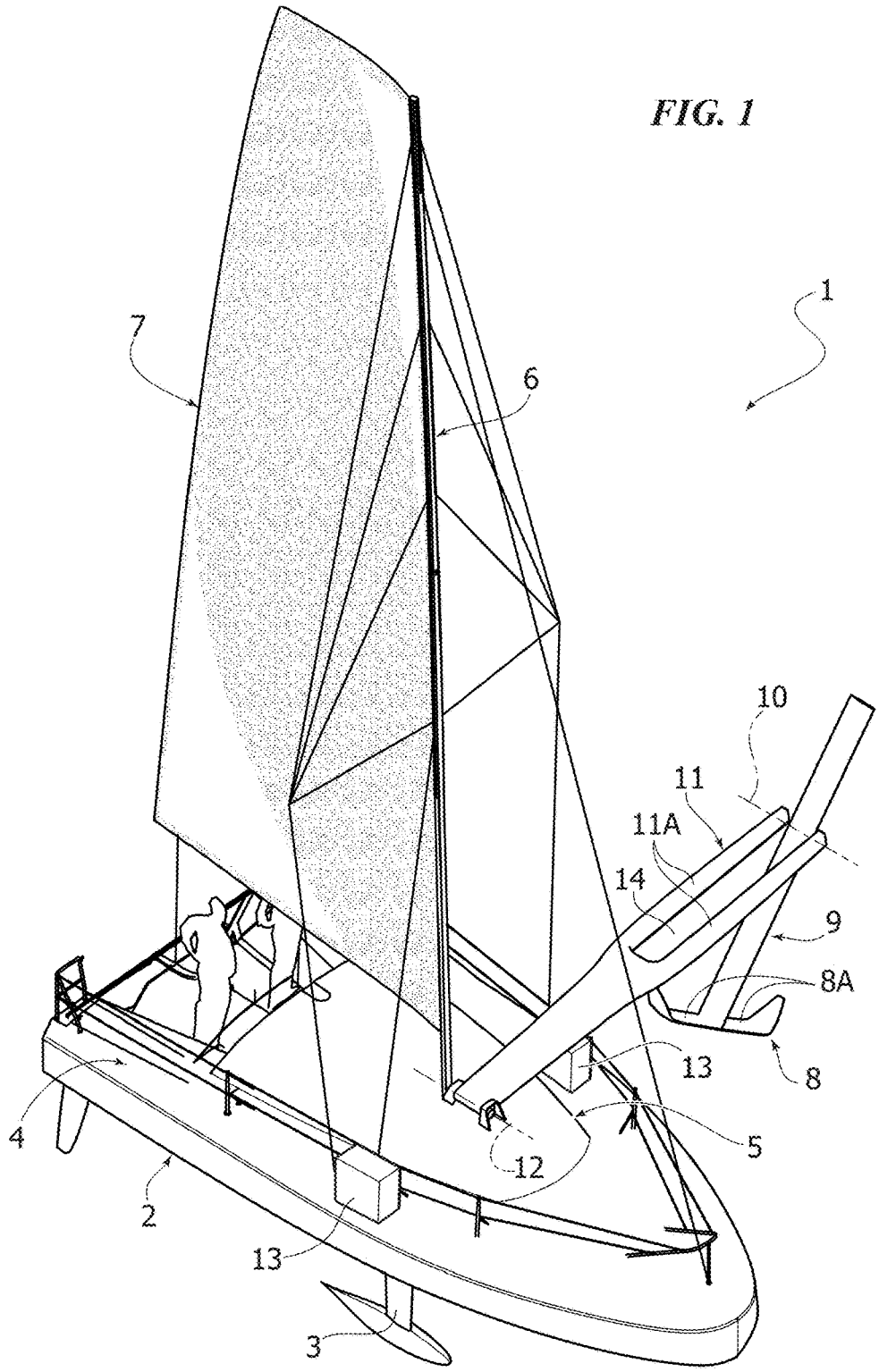
FIG. 1 is a perspective view of a preferred embodiment of a boat according to the invention.
Figure 1A:
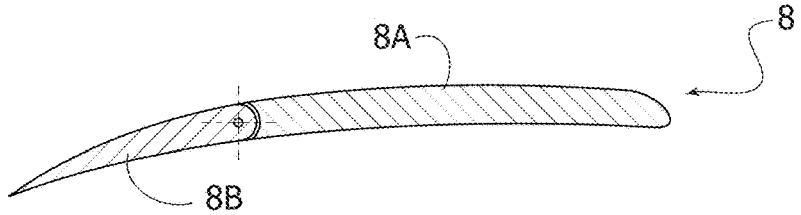
FIG. 1A illustrates at an enlarged scale a cross section of an auxiliary hydrodynamic surface used in the boat according to the invention.

In the example illustrated, the hydrodynamic surface 8 comprises two hydrofoils 8A projecting transversely in opposite directions from one end of the auxiliary boom 9. FIG. 1A shows at an enlarged scale and in cross-sectional view an example of configuration of the hydrodynamic surface 8. In a way similar to the wing of an aeroplane, each portion 8A may be provided with an oscillating flap 8B. In this case, associated to the oscillating flap is a drive of any known type, controlled by an actuator device of any known type (for example, an electric motor).

Once again in the case of the example illustrated, the free ends of the two hydrofoil portions 8A are bent upwards (with reference to the operative condition, for example illustrated in FIG. 4), in a way similar to a technique used in aeroplane wings, to guide and contain the hydrodynamic flow on the hydrofoils.

The drive system that controls the position of the main boom 11 may be motorized or manual. The same applies to the drive system that controls the position of the auxiliary boom 9 with respect to the main boom 11. It is also possible to envisage that associated to the auxiliary boom is a position-control system configured in such a way as to force the auxiliary boom to assume a position depending uniquely upon the position of the main boom.

According to a further preferred characteristic, the superstructure of the boat comprises lateral supports 13, designed to receive and support the main boom 11 when the latter is lowered on one side or the other of the boat so as to alleviate the stresses to which the main boom 11 is subject and prevent or reduce the bending strains of the main boom 11.

Figure 2:
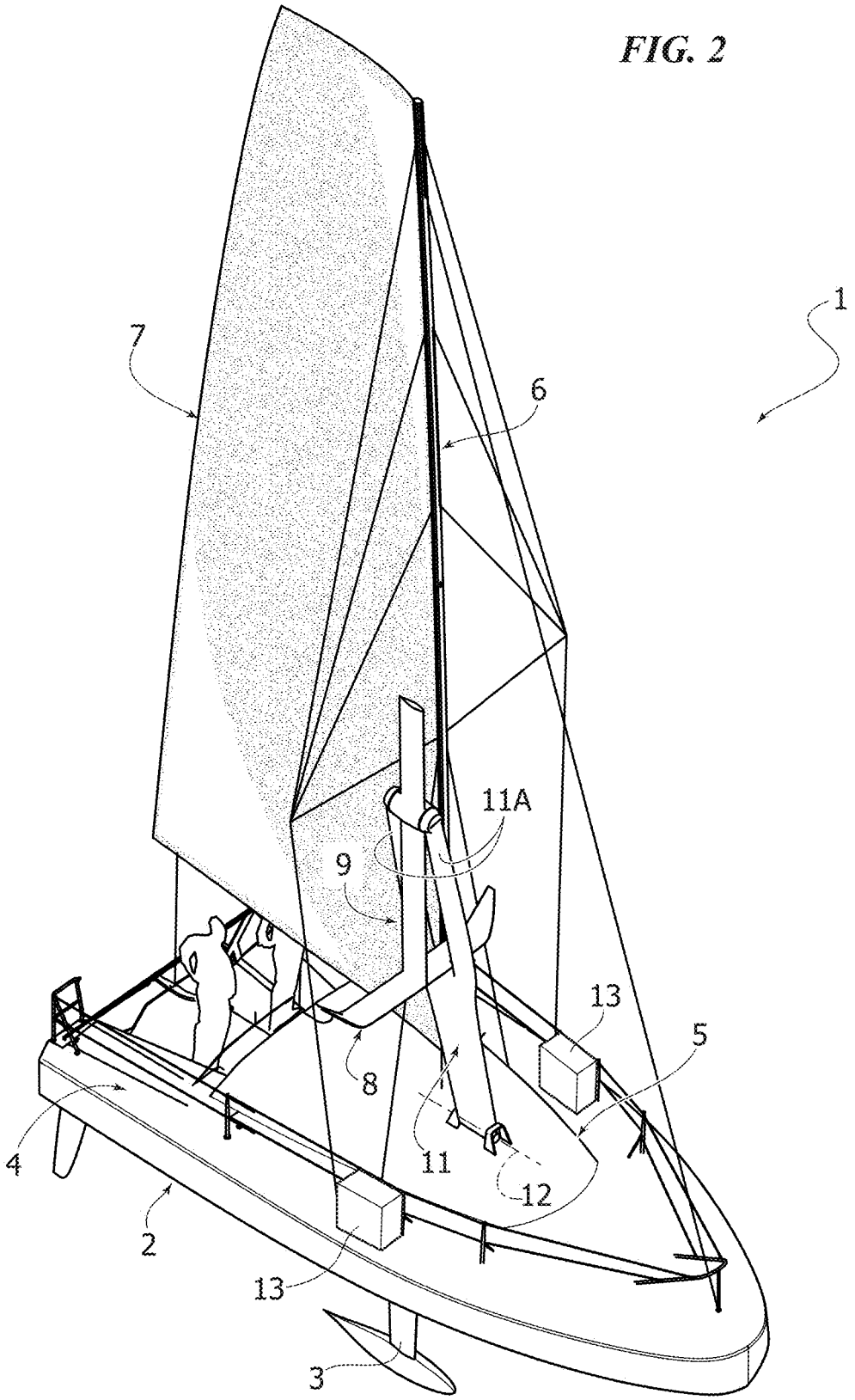
FIGS. 2 and 3 are further perspective views of the boat of FIG. 1 in different operative conditions.

As may be seen from the drawings, in the case of the example illustrated, the interference between the auxiliary boom 9 and the main boom 11 when the main boom 11 is brought from one side to the other of the boat is prevented owing to the fact that the main boom 11 has a forked structure with two mutually parallel boom elements 11A set apart from one another, which define between them a space 14 through which the auxiliary boom 9 and the hydrodynamic surface 8 can pass when the main boom 11 is displaced from one side to the other of the boat (see FIG. 2).

Once again according to a further characteristic, to the main boom 11 it is possible to associate stays or reinforcement elements having the purpose of alleviating the bending stresses to which the main boom is subject when it is located in one of its two operative positions on one side or the other of the boat.

As is evident from FIG. 4, the main boom 11 is configured and sized in such a way that, when it is located in one of its two operative positions, on one side or the other of the boat, the hydrodynamic surface 8 is put into the water at a relatively large distance from the hull of the boat, which enables considerable improvement of the performance of the boat over a boat of equal width provided with foils of a conventional type.

Preferably, when the hydrodynamic surface 8 is lowered into the water, the distance between the side of the hull 2 that faces the surface 8 and the end of the surface 8 that is closer to the hull is equal to at least one half of the total width (in a direction transverse to the longitudinal direction of the boat) of the hydrodynamic surface 8.

FIG. 7 shows an example of drive system 100 for driving movement of the main boom 11. In this case, the drive system comprises a halyard cable 15 for lifting the free end of the main boom 11 into a central position above the boat, and two downhaul cables 16A, 16B for pulling the main boom 11 downwards, one cable towards one side and the other towards the other side of the boat. The cables 15, 16A, 16B can be driven in any known way, for example by means of motorized (e.g., using motors 120 of a motorized drive system 125) or manually driven pulleys and winches 135 (of a manual drive system 130). FIG. 10 depicts a variation of FIG. 7 with the same features as FIG. 7 except for manual drive system 130 replacing motorized drive system 125.

Preferably, associated to the auxiliary boom 9 is a position-control system 110 configured in such a way as to force the auxiliary boom 9 to be in a position depending uniquely upon the position of the main boom 11. FIG. 7 shows an example in which the auxiliary boom 9 is connected to a pulley 18 (of position control system 110) rotatable on the end of the main boom 11 about the axis of articulation of the auxiliary boom 9. The pulley is connected to two cables (of position control system 110) that run parallel along the main boom 11 in such a way that, as the position of the main boom 11 varies, the auxiliary boom 9 sets itself according to a pre-set orientation.

Preferably, associated to the auxiliary boom 9 is a position-control system configured in such a way as to force the auxiliary boom 9 to be in a position depending uniquely upon the position of the main boom 11. FIG. 7 shows an example in which the auxiliary boom 9 is connected to a pulley 18 rotatable on the end of the main boom 11 about the axis of articulation of the auxiliary boom 9. The pulley is connected to two cables that run parallel along the main boom 11 in such a way that, as the position of the main boom 11 varies, the auxiliary boom 9 sets itself according to a pre-set orientation.

FIG. 8 shows a variant in which the hydrodynamic surface 8 is in the form of a rotor 19 with one or more blades, which has an axis of rotation that, in the operative condition in the water, is substantially vertical, said rotor being configured to operate with autorotation and/or with rotation controlled by an electric motor/alternator (capable of recovering energy). To counter the effect of rotation on the boat, it will be possible to orient the rudder at an angle or envisage other propellers of a similar type but rotating in the opposite direction.

FIG. 9 shows a solution in which the auxiliary hydrodynamic surface 8 comprises two pairs of hydrofoils 8A, set on top of one another and at a distance apart, which project in opposite transverse directions from said auxiliary boom 9.

In a further embodiment (not illustrated), the main boom 11 is connected to the deck 5 of the boat in such a way that, when it is located in one of its two operative positions, it can rotate, about a vertical axis passing through the point of connection of the main boom 11 to the deck 5 so as to displace the hydrodynamic surface 8 towards the bow or towards the stern of the boat.

In a further variant (not illustrated either), the hydrodynamic surface 8 is rotatable about a vertical axis when it is located in an operative position in the water.

Of course, without prejudice to the principle of the invention, the details of construction and the embodiments may vary widely with respect to what has been described and illustrated herein purely by way of example, without thereby departing from the scope of the present invention.

What is claimed is:

1. A sailing boat provided with an auxiliary hydrodynamic surface connected to a deck and movable between a raised, inoperative, position and a lowered, operative, position, in which the auxiliary hydrodynamic surface is put into water on one side of a hull of the boat, the boat comprising:

a hydrodynamic surface carried by a main boom pivotally connected to a deck of the boat about an axis of articulation parallel to a longitudinal direction of the boat, and a motorized drive system for lowering the main boom on one side or another of the boat in such a way that said hydrodynamic surface carried by the main boom is selectively lowerable in a first operative position on one side of the boat to be put into water on one side of the boat or in a second operative position on the other side of the boat to be put into the water on the other side of the boat, said main boom being sized in such a way that, when the hydrodynamic surface is located in one of the first operative position or the second operative position on one side or the other of the boat, said main boom is set at a lateral distance from the hull of the boat.

2. The sailing boat according to claim 1, wherein the main boom is connected in an articulated way to a central portion of a deck of the boat about said axis substantially parallel to the longitudinal direction of the boat, and said auxiliary hydrodynamic surface is carried by an auxiliary boom connected in an articulated way to one end of said main boom, about an axis substantially parallel to said axis of articulation of the main boom to the deck of the boat.

3. The sailing boat according to claim 2, wherein said auxiliary hydrodynamic surface comprises two hydrofoils projecting in opposite transverse directions from said auxiliary boom.

4. The sailing boat according to claim 2, wherein said auxiliary hydrodynamic surface comprises two pairs of hydrofoils, set on top of one another and at a distance apart, which project in opposite transverse directions from said auxiliary boom.

5. The sailing boat according to claim 3, wherein each of said hydrofoils is provided with a flap.

6. The sailing boat according to claim 2, wherein said auxiliary hydrodynamic surface is in the form of a rotor with one or more blades, which has an axis of rotation that, in an operative condition in the water, is substantially vertical, said rotor being configured to operate with autorotation and/or with controlled rotation.

7. The sailing boat according to claim 1, further comprising lateral supports on the superstructure of the boat, which receive and support said main boom when said main boom is lowered on one side or the other of the boat.

8. The sailing boat according to claim 2, further comprising a motorized drive system for controlling an auxiliary position of the auxiliary boom with respect to the main boom.

9. The sailing boat according to claim 2, further comprising a manual drive system for controlling the auxiliary position of the auxiliary boom with respect to the main boom.

10. The sailing boat according to claim 2, wherein associated to said auxiliary boom is a position-control system configured in such a way as to force the auxiliary boom to be in the auxiliary position depending uniquely upon the position of the main boom.

11. The sailing boat according to claim 1, wherein said drive system that controls the position of the main boom comprises a halyard cable for lifting the free end of the main boom into a central position above the boat, and two downhaul cables for pulling the main boom downwards, one cable towards one side and the other towards the other side of the boat.

12. The sailing boat according to claim 1, wherein said main boom is connected to the deck of the boat in such a way that, when said hydrodynamic surface is located in one of the two operative positions, said main boom can rotate, about a vertical axis passing through the point of connection of the main boom to the deck, so as to move the hydrodynamic surface towards a bow or towards a stern of the boat.

13. The sailing boat according to claim 1, wherein the hydrodynamic surface is rotatable about a vertical axis, when the hydrodynamic surface is located in one of the two operative positions in the water.

14. A sailing boat provided with an auxiliary hydrodynamic surface connected to a structure of the boat and movable between a raised, inoperative, position and a lowered, operative, position, in which the auxiliary hydrodynamic surface is put into water on one side of the hull of the boat, the boat comprising:

a hydrodynamic surface carried by a main boom pivotally connected to a deck of the boat about an axis of articulation parallel to a longitudinal direction of the boat, and a manual drive system for lowering the main boom on one side or the other of the boat in such a way that said hydrodynamic surface carried by the main boom is selectively lowerable in a first operative position on one side of the boat to be put into water on one side of the boat or in a second operative position on the other side of the boat to be put into the water on the other side of the boat, said main boom being sized in such a way that, when the hydrodynamic surface is located in one of the first operative position or the second operative position on one side or the other of the boat, said main boom is set at a lateral distance from a hull of the boat.

15. The sailing boat according to claim 14, wherein said auxiliary hydrodynamic surface comprises two pairs of hydrofoils, set on top of one another and at a distance apart, which project in opposite transverse directions from said auxiliary boom.

16. The sailing boat according to claim 15, wherein each of said hydrofoils is provided with a flap.

17. The sailing boat according to claim 2, wherein said auxiliary hydrodynamic surface is in the form of a rotor with one or more blades, which has an axis of rotation that, in an operative condition in the water, is substantially vertical, said rotor being configured to operate with autorotation and/or with controlled rotation.

18. The sailing boat according to claim 14, wherein said main boom is connected to the deck of the boat in such a way that, when said hydrodynamic surface is located in one of the two operative positions, said main boom can rotate, about a vertical axis passing through the point of connection of the main boom to the deck, so as to move the hydrodynamic surface towards a bow or towards a stern of the boat.

* * * * *